US006508495B1

(12) United States Patent
Riley

(10) Patent No.: US 6,508,495 B1
(45) Date of Patent: Jan. 21, 2003

(54) LATCH ASSEMBLY FOR COVERED CONTAINERS

(76) Inventor: Edward D. Riley, 16 Brookside Dr., Falmouth, ME (US) 04105

( * ) Notice: Subject to any disclaimer, the term of this patent is extended or adjusted under 35 U.S.C. 154(b) by 0 days.

(21) Appl. No.: 09/997,789

(22) Filed: Nov. 30, 2001

(51) Int. Cl.[7] ..... E05C 1/04

(52) U.S. Cl. ..... 292/152; 292/19; 292/31; 292/42; 292/101; 292/102; 292/103; 292/107; 292/137; 292/145; 292/146; 292/147; 292/150; 292/153; 292/256.5; 292/DIG. 11; 292/DIG. 30; 292/DIG. 53; 24/637; 220/326

(58) Field of Search ..... 292/152, 153, 292/145, DIG. 11, DIG. 53, 137, 150, 256.5, DIG. 30, 19, 31, 42, 101, 102, 103, 107, 146, 147; 220/326; 24/637

(56) References Cited

U.S. PATENT DOCUMENTS

| | | | | | |
|---|---|---|---|---|---|
| 1,189,969 | A | * | 7/1916 | Kimball | 292/174 |
| 1,619,913 | A | * | 3/1927 | Baruch | 292/145 |
| 1,632,832 | A | * | 6/1927 | Gold | 292/152 |
| 1,653,015 | A | * | 12/1927 | Koelln | 292/152 |
| 2,305,411 | A | * | 12/1942 | Fitzpatrick | 292/150 |
| 4,400,026 | A | * | 8/1983 | Brown | 292/175 |
| 4,669,765 | A | * | 6/1987 | Ullman | 292/153 |
| 4,746,152 | A | * | 5/1988 | Willcox | 292/150 |
| 4,817,799 | A | * | 4/1989 | Gregerson et al. | 206/445 |
| 4,867,491 | A | * | 9/1989 | Arnold | 292/150 |
| 4,901,475 | A | * | 2/1990 | Simpson | 49/175 |
| 4,908,917 | A | * | 3/1990 | Kazle | 24/615 |
| 5,419,617 | A | * | 5/1995 | Schultz | 297/411.27 |
| 5,445,451 | A | * | 8/1995 | Harmony | 312/333 |
| 5,603,184 | A | * | 2/1997 | Campbell et al. | 49/394 |
| 5,702,135 | A | * | 12/1997 | Burres | 292/145 |
| 5,706,968 | A | | 1/1998 | Riley | |
| 5,887,745 | A | * | 3/1999 | Wood | 220/326 |
| 5,957,323 | A | * | 9/1999 | Terracciano et al. | 220/574 |
| 6,212,366 | B1 | * | 4/2001 | Cheraso et al. | 455/90 |

FOREIGN PATENT DOCUMENTS

| | | | | |
|---|---|---|---|---|
| DE | 4016285 A1 | * | 4/1991 | 292/152 |
| FR | 7925368 A1 | * | 4/1981 | 292/152 |

* cited by examiner

*Primary Examiner*—J. J. Swann
*Assistant Examiner*—Carlos Lugo
(74) *Attorney, Agent, or Firm*—Cesari and McKenna LLP

(57) ABSTRACT

A latch assembly for securing a cover to a container comprises a base for mounting to the container cover adjacent to an edge thereof, a cover member secured to the base and a slider slidable between the base and cover member between a latched position wherein a portion of the slider interfits with the container and an unlatched position wherein the slider portion is disengaged from the container. A headed spring member interposed between the slider and the base interfits with openings in the slider to signal when the slider has reached its latched and unlatched positions and to releasably retain the slider at those positions.

12 Claims, 2 Drawing Sheets

LATCH ASSEMBLY FOR COVERED CONTAINERS

FIELD OF THE INVENTION

This invention relates to covered containers. It relates more particularly to a latch assembly for releasably retaining a cover to a container. The latch assembly is especially advantageous for use on surgical instrument sterilization trays.

BACKGROUND OF THE INVENTION

A sterilization tray usually comprises a base container with an open top for holding surgical instruments or other articles. The open top of the base container may be closed by a cover which engages over the top of the container. Preferably, the cover and/or the base container are perforated so that steam can circulate through the closed container. To prevent the cover from becoming disengaged from the base container during handling, means are usually provided for releasably securing the cover to that container.

Conventionally, the securing means often consist of at least one latch which is usually mounted to one of the base container and cover and which is movable between a locked position wherein the latch engages over the other of the base container and cover, and an unlocked position wherein the latch is released from the other of the base container and cover. One such prior latch in widespread use consists of a rolled metal bracket hinged to the edge of the cover and a rolled metal hook pivotally connected to the bracket at a location thereon spaced from the bracket hinge. To lock the cover, the hook is swung down so that the hook engages a hole or projection in the base container and then the bracket is swung down to a stable over center position against the cover so that tension is applied to the hook whereupon the hook remains tightly engaged to the base container.

While that prior cover securement operates satisfactorily in many respects, it is disadvantaged in that if the closed container should be dropped onto a hard surface, the bracket may move away from it over-center position due to inertia. Resultantly, the hook member may become disengaged from the base container thereby allowing the cover to separate from the base container so that the contents of the container can spill onto the floor.

As an improvement to that over center-type latch arrangement, we developed a safety clasp assembly disclosed in U.S. Pat. No. 5,706,968. It comprises a rocker, an axle pivotally connecting the rocker to the container cover and a slider positioned between the axle and the cover. The slider is slidable along the cover in a direction perpendicular to the axle between a locked position wherein the slider interfits with the base container and an to unlocked position wherein the slider is disengaged from that container. When the slider is in its locked position, portions of the rocker and slider interfit preventing movement of the latter. In order to move the slider to its unlocked position, the rocker has to be rocked about its axle against a spring bias to disengage the rocker from the slider allowing the latter to move to be moved to its unlocked position.

While that safety clasp assembly has definite advantages over the then prior art, it also has a few drawbacks. More particularly, the container cover has to be modified to form eyes in the container cover to anchor the axle ends of each clasp assembly. Also, some people find it difficult to move simultaneously both the rocker and the slider as necessary to release the clasp using only one hand. Resultantly, some people have been reluctant to use sterilization trays incorporating such clasp assemblies.

Accordingly, it would be desirable to be able to provide securing means for reliably releasably securing a cover to a sterilization tray or other base container, which is easy to operate using only one hand, yet does not require modification of the cover or container.

SUMMARY OF THE INVENTION

Accordingly, it is an object of the present invention to provide an improved latch assembly for releasably securing a cover to a sterilization tray or other such base container.

Another object of the invention is to provide a latch assembly of this type which can be moved between its latched and unlatched positions quite easily only using one hand.

Another object of the invention is to provide such a latch assembly which is relatively easy and inexpensive to make and to assemble.

A further object of the invention is to provide a latch assembly of this general type which can be installed on a conventional cover without requiring any appreciable modification of the cover or container.

A further object of the invention is to provide a latch assembly which signals when it is in its latched and unlatched conditions.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the present latch assembly for securing a cover to a container comprises a base for mounting to the container cover adjacent to an edge thereof, a cover member secured to the base and a slider slidable along a passage between the base and cover member between a latched position wherein a portion of the slider interfits with the container and an unlatched position wherein the slider portion is disengaged from the container. A headed spring member interposed between the slider and the base resiliently interfits with holes in the slider to signal when the slider has reached its latched and unlatched positions and to releasably retain the slider at those positions.

BRIEF DESCRIPTION OF THE DRAWING

For a fuller understanding of the nature and objects of the invention, reference should be made to the following detailed description taken in connection with the accompanying drawing, in which.

DESCRIPTION OF THE PREFERRED EMBODIMENT

Figure 1:
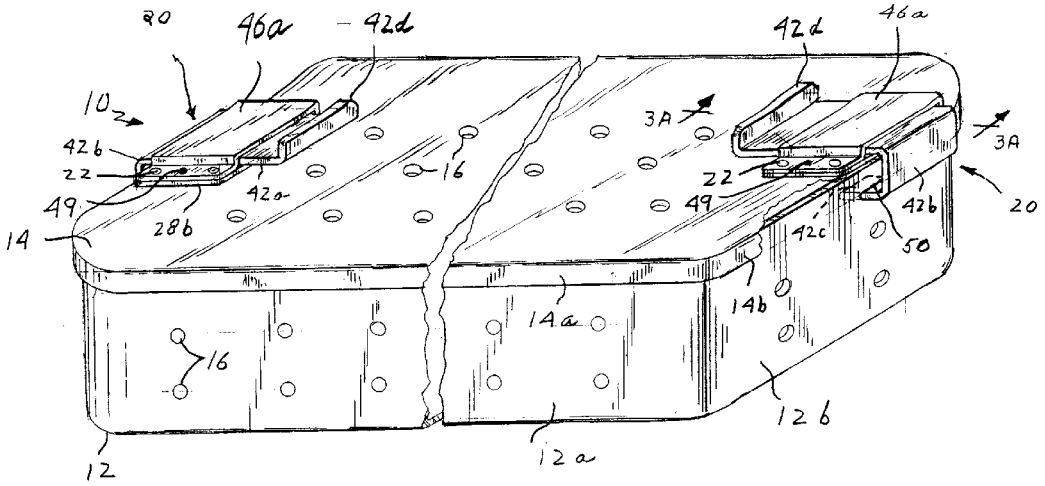
FIG. 1 is a perspective view with parts broken away of an instrument sterilization tray having latch assemblies incorporating the invention.

Refer now to FIG. 1 of the drawings which shows a generally rectangular surgical instrument sterilization tray 10. Tray 10 is composed of a relatively deep base container 12 having a pair of opposite sidewalls 12*a*, 12*a* and a pair of opposite endwalls 12*b*, 12*b*. The top of the base container 12 is normally open but may be closed by a cover 14 having a pair of opposite sidewalls 14*a*, 14*a*, and a pair of opposite endwalls 14*b*, 14*b*. When cover 14 is seated on container 12, the cover walls 14*a*, 14*b*, overlap or interfit with the corresponding container walls 12*a*, 12*b*. Preferably, container 12 and cover 14 are made ii 20 of a strong impact-resistant plastic material able to withstand sterilization temperatures. Preferably also, the cover and/or the base container is formed with a multiplicity of holes 16 through which steam may circulate when instruments in tray 10 are being sterilized.

In order to releasably lock cover 14 to container 12, the tray 10 is provided with a pair of mirror-image latch assemblies shown generally at 20 situated at opposite ends of the tray. Latch assemblies 20 lock cover 14 to base container 12 during the sterilization process and during handling. However, the assemblies 20 can be released easily by operating room personnel, using only one hand, when it is necessary to remove cover 14 in order to use the sterilized instruments in container 12.

Figure 3A:
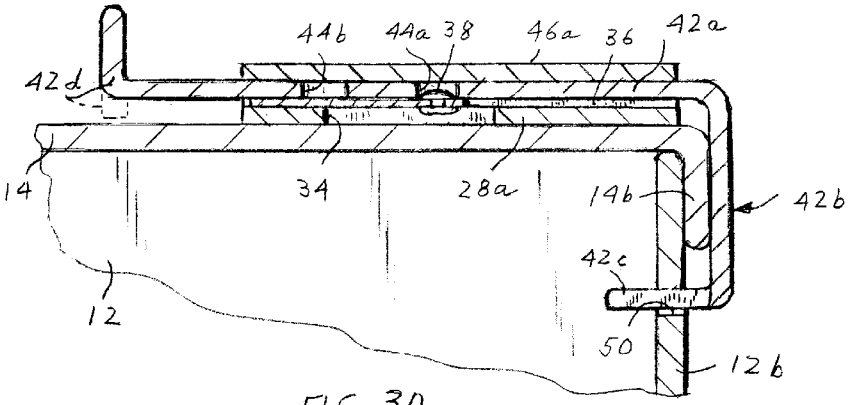
FIG. 3A is sectional view on a larger scale taken along line 3A—3A of FIG. 1, lo showing the latch assembly in its latched condition.
Figure 3B:
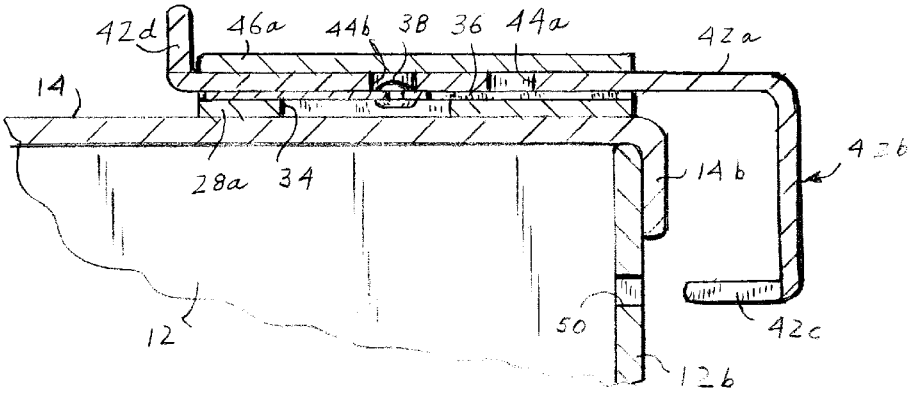
FIG. 3B is a similar view showing the latch assembly in its unlatched condition.

Each latch assembly 20 is secured by fasteners 22 to cover 14 near an endwall 14*b* thereof and is adapted to releasably interfit with the underlying endwall 12*b* of base container 12 when the assembly is in its locked position shown in FIGS. 1 and 3A and to be spaced and disengaged from that container endwall when the assembly is in its unlocked position shown in FIG. 3B.

Figure 2:
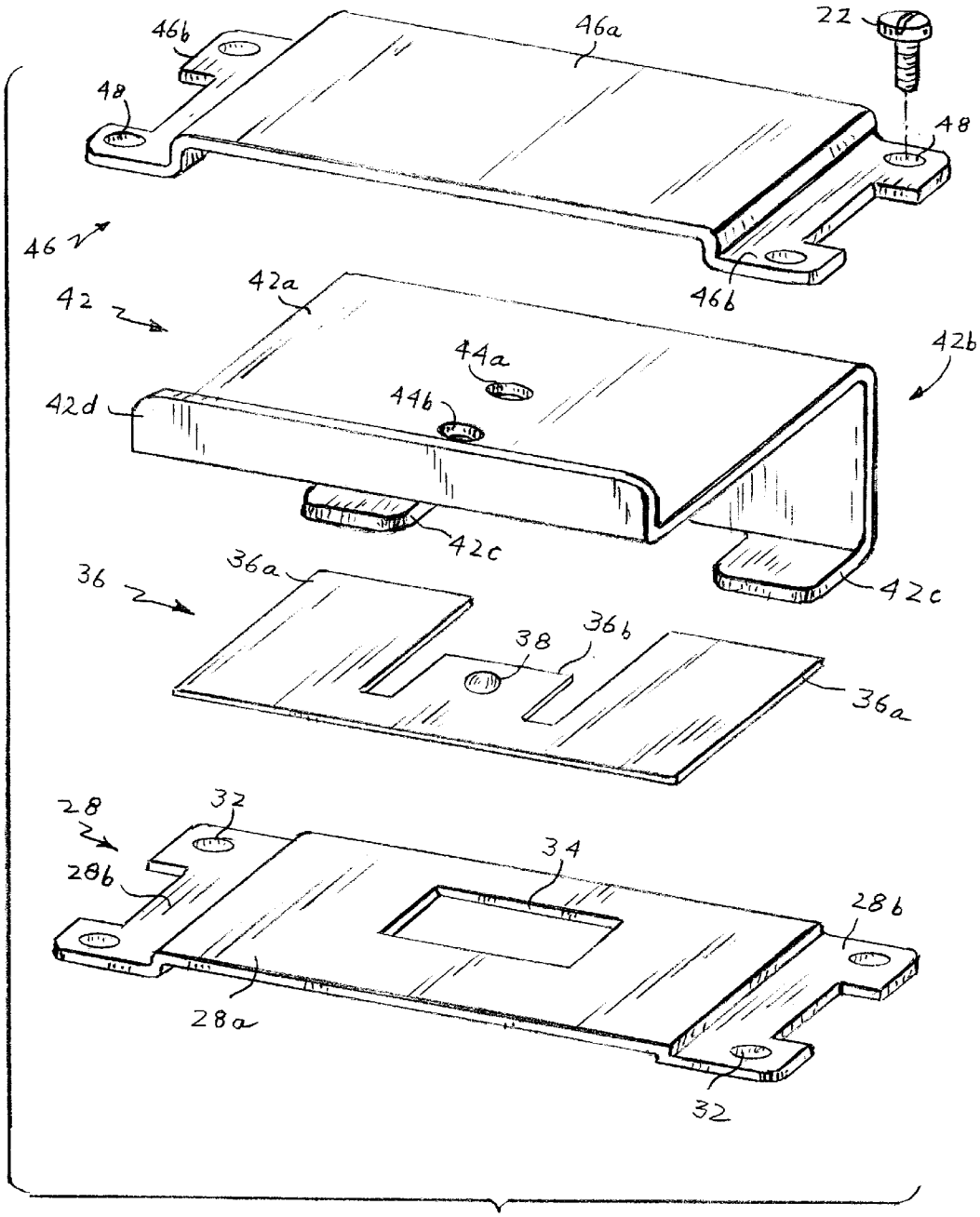
FIG. 2 is an exploded perspective view on a larger scale showing in greater detail the components of each latch assembly in the FIG. 1 tray.

As best seen in FIG. 2, each assembly 20 comprises four main parts which are stacked one on top of the other. More particularly, the assembly includes a base shown generally at 28 which is essentially a flat, generally rectangular plate formed with a relatively long center segment 28*a* which may be raised relative to a pair of opposite end segments 28*b*. Fastener holes 32 are present at the four corners of base 28 in segments 28*b* and a relatively large, generally rectangular window or hole 34 is present in the raised segment 28*a* for reasons that will become apparent.

The second component of assembly 20 is a spring member shown generally at 36. Member 36 is essentially a thin flat plate preferably of a metal such as spring steel. The spring member 36 has more or less the same dimensions as the raised segment 28*a* of base 28. Member 36 is also notched to form a pair of generally rectangular, full-width end sections 36*a*, 36*a*, which bracket a narrower laterally extending section or tab 36*b*. When spring member 36 is centered on the raised segment 28*a* of base 28, tab 36*b* is cantilevered out over the window or hole 34 in the raised segment 28*a*. As shown in FIG. 2, for reasons that will become apparent, a raised head or protuberance 38 is formed adjacent to the free edge of tab 36*b*. That head may be a blind fastener inserted through tab 36*b* or the head may be created by deforming tab 36*b* or by adhering, welding or brazing the head to the tab. In any event, head or protuberance 38 should be on the side of the spring member 36 facing away from base 28.

Still referring to FIG. 2, the third element of latch assembly 20 is a slider shown generally at 42. The illustrated slider is a stamped metal part having a generally rectangular top wall 42*a* whose length is comparable to that of the base segment 28*a* and whose width is appreciably greater than that segment. The slider also includes an integral hook 42*b* which extends down from a long edge of top wall 42*a*. The hook has one or more legs 42*c* extending back parallel to top wall 42*a* from a location spaced appreciably below that wall. Also, slider 42 is formed with a lip 42*d* at the opposite long edge of top wall 42*a*. The lip may extend up as shown in solid lines in the drawings or down as shown in phantom in FIG. 3A. As we shall see, lip 42*d* provides a finger grip for operating the latch assembly.

Positioned more or less midway along the length of top wall 42*a* of slider 42 is a pair of holes 44*a* and 44*b* spaced apart laterally on wall 42*a* so that when the slider 42 is centered on the spring member 36, the imaginary line extending between holes 44*a* and 44*b* is aligned with the head 38 on spring member 36.

The final component of latch assembly 20 is a cover member shown generally at 46 in FIG. 2. Cover member 46 is a stamped metal part having a raised central segment 46*a* bracketed by two end segments 46*b*. The width of raised segment 46*a* is comparable to that of the raised segment 28*a* of base 28. However, its length is slightly greater than that of base segment 28*a*. As with base 28, fastener holes 48 are provided at the four corners of cover member 46 in the end segments 46*b* thereof.

When the latch assembly parts shown in FIG. 2 are properly assembled as seen in FIGS. 3A and 3B, they are stacked one above the other such that the holes 48 in the cover member 46 line up with the corresponding holes 32 in the base 28 and such that the spring member tab 36*b* overlies the window 34 in the base member. During such assembly, the spring member 36 is preferably spot-welded or otherwise secured to base segment 28*a* to fix the relative positions of those parts. Likewise, after cover member 46 is, properly aligned with base 28, those two members may be permanently secured together by spot-welds 49 (FIG. 1) at end segments 46*b* and 28*b*. In that completed assembly, the holes 48 in the cover member 46 and the holes 32 in the base 28 are in alignment to receive the fasteners 22 that secure the latch assembly to cover 14 as shown in FIG. 1.

Also when the parts are assembled, the spring tab 36*b* is deflected downward by the engagement of the head 38 against the underside of the slider so that the head is biased upward. The window or hole 34 in base 28 provides clearance for the deflected tab 36*b*.

When the latch assembly 20 is in its latched condition shown in FIGS. 1 and 3A, slider 42 is positioned inwardly on the tray cover 14 so that the slider hook 42*b* is close enough to the corresponding endwall 12*b* of container 12 that the hook leg(s) 42*c* project through slot(s) 50 formed in that wall. This interfitting engagement of the slider with the container endwall prevents cover 14 from becoming separated from container 12.

As noted previously, the head 38 on the spring tab 36*b* is biased upwardly against the underside of slider 42. Therefore, when the slider reaches its latched position shown in FIG. 3A, the head 38 snaps into the hole 44*a* in the underside of the slider top wall 42*a* thereby providing an audible and tactile signal that the slider is in its latched position. Also, the resilient engagement of the head 38 in hole 44*a* releasably retains the slider in its latched position. Overtravel of the slider in the latching directing is prevented by the engagement of slider hook 42*b* against the adjacent side edge of the base which edge thus functions as a stop.

To unlock latch assembly 20 in order to remove cover 14 from base container 12, the operator, using a thumb or finger, exerts an outward force on slider lip 42*d* that is sufficiently strong to overcome the bias of spring tab 36*b* and dislodge head 38 from hole 44*a*. The outward motion of the slider retracts the hook leg(s) 42*c* from slot(s) 50 in the base endwall 12*b* as shown in FIG. 3B. When the slider reaches its unlatched position, the head 38 on spring member 36 will snap into the other hole 44*b* in the underside of the slider top wall 42*a* thereby providing an unlatch signal and releasably retaining the slider in its unlatched position. Overtravel of the slider beyond that position is prevented by the engagement of lip 42*d* against the adjacent side edge of cover member 46 (or base 28) which edge thus functions as a stop.

The latch assembly described herein is composed of a minimum number of parts which are easy and inexpensive to make in quantity. Therefore, the assembly should not appreciably increase the overall cost of the sterilization tray on which it is installed. Furthermore, such installation does not require any alteration in the basic design of the tray to accommodate the assembly.

It will thus be seen that the objects set forth above, among those made apparent from the preceding description, are efficiently attained. Also, certain changes may be made in the above construction without departing from the scope of the invention. For example, the holes 34, 44*a* and 44*b* could be depressions instead of through holes and still fulfill their stated purposes. Also, the hook 42*b* of each assembly could just as well engage under a projection or ledge on the corresponding container endwall 12*b*. Therefore, it is intended that all matter contained in the above description or shown in the accompanying drawing shall be interpreted as illustrative and not in a limiting sense.

It is also to be understood that the following claims are intended to cover all of the generic and specific features of the invention described therein.

What is claimed is:

1. A latch assembly for latching a cover to a container, said latch assembly comprising a flat base having opposite end segments, an upper surface with a hole therein and a lower surface for contacting a cover;

a cover member substantially coextensive with and superimposed on said upper surface of the base, said cover member having opposite end margins seated against the opposite end segments of the base and a raised segment extending between the end margins of the cover member above said hole in the base to form a lateral passage between the base and the cover member, said passage having first and second open ends;

a slider slidably positioned in said passage and having a first end exposed at the first end of the passage, a second end exposed at the second end of the passage, an undersurface extending between said first and second ends, means defining first and second holes in said undersurface and a hook extending from the first end of the slider below the base, said slider being slidable along said passage between a latched position wherein a portion of the hook underlies the base and a unlatched position wherein the hook portion does not underlie the base, and a flat spring member fixed relative to the base, said spring member having a flexible, resilient portion extending opposite the hole in the base and a protuberance extending from said spring member portion toward the slider, the height of the protuberance being such that the protuberance engages the undersurface of the slider and deflects the spring member portion into the hole in the base, said first and second holes in the slider being positioned relative to the protuberance such that when the slider is in said latched position, the protuberance resiliently seats in the first hole and when the slider is in said unlatched position, the protuberance resiliently seats in the second hole.

2. The latch assembly defined in claim 1 and further including moving means to facilitate moving the slider between said latched and unlatched positions.

3. The latch assembly defined in claim 2 wherein said moving means include a lip extending from the second end of the slider substantially perpendicular to said undersurface.

4. The latch assembly defined in claim 3 wherein the lip extends above the cover member.

5. The latch assembly defined in claim 3 wherein the lip extends below the upper surface of the base.

6. The latch assembly defined in claim 1 and further including anchoring means for anchoring the end segments of the cover member to the end segments of the base.

7. The latch assembly defined in claim 6 wherein the anchoring means comprise spot welds.

8. The latch assembly defined in claim 1 and further including means defining aligned fastener holes in the end segments of the cover member and the base to facilitate securing the latch assembly to a cover.

9. The latch assembly defined in claim 1 wherein the spring member portion constitutes a leaf spring cantilevered opposite the hole in the base.

10. The latch assembly defined in claim 9 and further including means fixing the relative positions of the spring member and the base.

11. The latch assembly defined in claim 1 wherein said base has a raised segment extending between the end segments of the base and which contains said base hole and is generally coextensive with the raised segment of the cover member.

12. The latch assembly defined in claim 1 wherein the hole in the base and the first and second holes in the slider are through holes.

* * * * *